United States Patent [19]

Tsilibes

[11] 3,967,894

[45] July 6, 1976

[54] SCREENED OPTICAL SYSTEM

[75] Inventor: George N. Tsilibes, Rochester, N.Y.

[73] Assignee: Xerox Corporation, Stamford, Conn.

[22] Filed: Sept. 18, 1974

[21] Appl. No.: 507,176

[52] U.S. Cl. ..... 355/4; 355/67; 355/71

[51] Int. Cl.[2] ..... G03G 15/22

[58] Field of Search ..... 355/3 R, 4, 8, 11, 17, 355/19, 18, 67, 71; 96/116–118, 27 E, 45, 1.2; 350/318, 314, 315; 240/46.17

[56] References Cited

UNITED STATES PATENTS

| | | | |
|---|---|---|---|
| 1,676,600 | 7/1928 | Capstaff | 355/71 |
| 2,444,512 | 7/1948 | Kath | 350/315 UX |
| 2,643,187 | 6/1953 | Linzell | 96/116 |
| 3,120,790 | 2/1964 | Carlson et al. | 355/3 R |
| 3,517,596 | 6/1970 | Johnson et al. | 355/4 X |
| 3,580,671 | 5/1971 | Lavander | 355/71 X |
| 3,603,672 | 9/1971 | Bastide | 350/318 X |

*Primary Examiner*—L. T. Hix
*Assistant Examiner*—Kenneth C. Hutchison
*Attorney, Agent, or Firm*—H. Fleischer; C. A. Green; J. J. Ralabate

[57] ABSTRACT

An optical system in which a continuous tone light image of an original document is formed. The optical system is arranged to illuminate the original document and to create a finely divided uniformly distributed light image. A selectable feature therein permits the formation of light images having differing tone gradations.

9 Claims, 5 Drawing Figures

SCREENED OPTICAL SYSTEM

BACKGROUND OF THE INVENTION

This invention relates generally to an electrophotographic printing machine, and more particularly concerns an improved optical system adapted to produce continuous tone light images having substantially uniform intensity.

A typical electrophotographic printing machine has an optical system which forms a light image of an original document. The light image irradiates the charged photoconductive surface to record an electrostatic latent image thereon. The electrostatic latent image is then developed with charged particles to produce a powder image thereof. Thereafter, the powder image is transferred to a sheet of support material and permanently affixed thereto forming a copy of the original document. The foregoing process is described, in detail, in U.S. Pat. No. 2,297,691 issued to Carlson in 1942.

Multi-color electrophotographic printing is substantially similar to the heretofore discussed process. However, rather than forming a total light image of the original document, successive filtered light images are formed to produce successive single color light images which are partial light images of the original document. These successive single color light images irradiate the charged photoconductive surface to form successive single color electrostatic latent images thereon. Each single color electrostatic latent image is developed with toner particles of a color complementary to the respective filtered light image. The single color toner powder images are transferred from the electrostatic latent image to a sheet of support material, in superimposed registration with one another. After the multi-layered toner powder image is formed on the sheet of support material, it is permanently affixed thereto forming a color copy thereon.

Conventional screening methods may be employed in an electrophotographic printing machine. Such methods produce the effect of tone gradations plus variations in dot size. In the highlights, the dots will be small and will increase in size through the intermediate shades until they merge together in the shadow region. At the extremes, there will be complete whiteness at the highlight end of the tone scale, and nearly solid black at the shadow end. This type of tone structure can be reproduced in an electrophotographic printing machine.

Numerous techniques for screening have hereinbefore been developed. By way of example, U.S. Pat. No. 2,598,732 describes the use of a screen in electrophotographic printing. Another example is found in U.S. Pat. No. 3,724,944 which relates to the use of a screen in a belt configuration.

In addition to forming a continuous tone light image of an original document, it is highly desirable to insure that the light image irradiating the charged photoconductive surface has substantially uniform intensity. The density of toner particles deposited on an electrostatic latent image is dependent upon the voltage level of the development system relative to the electrostatic latent image. Toner particles are attracted to those surfaces of the photoconductive surface having a voltage thereon greater than that of the development system. The areas of the photoconductive surface which are irradiated by the single color light image are discharged. The degree of discharge is dependent upon the intensity of the light rays impinging thereon. However, it is well known that the illumination at an image point is in proportion to the $\cos^4$ of the solid angle between the illumination point and the image point. Thus, it can be seen that the illumination of the photoconductive surface will fall off quite rapidly as the solid angle increases. Various approaches have been devised to compensate for this effect. Typically, a sheet of opaque material having a "butterfly" slit formed therein is employed. The area of the butterfly slit is inversely proportional to the illumination profile. Other techniques employ masks having slits of this type integral with the lens system. Techniques of this nature are examplified by U.S. Pat. No. 3,224,327 and U.S. Pat. No. 3,469,916 which relate to a mask in the path of a light image having an opening in the middle narrower than at the end.

However, it is highly desirable to have a capability of varying the intensity of the light image transmitted to the photoconductive surface. The foregoing will compensate for aging effects of the light source and permit the selection of the appropriate slit for the functional or pictorial mode of operation. In addition, during the calibration process of the electrophotographic printing machine, the appropriate size exposure slit is chosen. This is achieved by choosing different exposure slits of varying widths. Heretofore, numerous exposure slits have been contained loosely in the electrophotographic printing machine enabling the operator to select the appropriate slit during calibration. Frequently, this results in the loss of the exposure slit. The foregoing increases the calibration time and cost of parts.

Furthermore, in multi-color electrophotographic printing machine, it may be highly desirable to employ a screen in certain modes of operation in conjunction with the exposure slit (pictorial mode) and, in other modes of operation, to space the screen from the optical light path (functional mode). Thus, in a photographic or pictorial mode of operation a screen would be employed. Contrawise, if the machine is operated in a functional mode wherein graphs or line copies are being reproduced in a multi-color mode, a screen is not desirable. In addition, various types of screens may be employed in order to provide an appropriate composition for the type of copy being produced.

Accordingly, it is a primary object of the present invention to provide an electrophotographic printing machine having an improved optical system arranged to produce continuous tone light images of variable light intensity.

SUMMARY OF THE INVENTION

Briefly stated, and in accordance with the present invention, there is provided an optical system for creating a light image of an original document.

In the optical system of the present invention, a light source is arranged to illuminate an original document with light rays. The light rays transmitted from the original document are formed into a light image by lens means. Indexing means position a selected one of a plurality of screen members in the optical light path. In this manner, the selected screen member is in a light receiving relationship with the light image being transmitted from the lens means.

BRIEF DESCRIPTION OF THE DRAWINGS other objects and advantages of the present invention will become apparent upon reading the following detailed description and upon reference to the drawings, in which.

While the present invention will be described in connection with the preferred embodiment thereof, it will be understood that it is not intended to limit the invention to that embodiment. On the contrary, it is intended to cover all alternatives, modifications, and equivalents as may be included within the spirit and broad scope of the invention as defined by the appended claims.

DETAILED DESCRIPTION OF THE INVENTION

Figure 1:
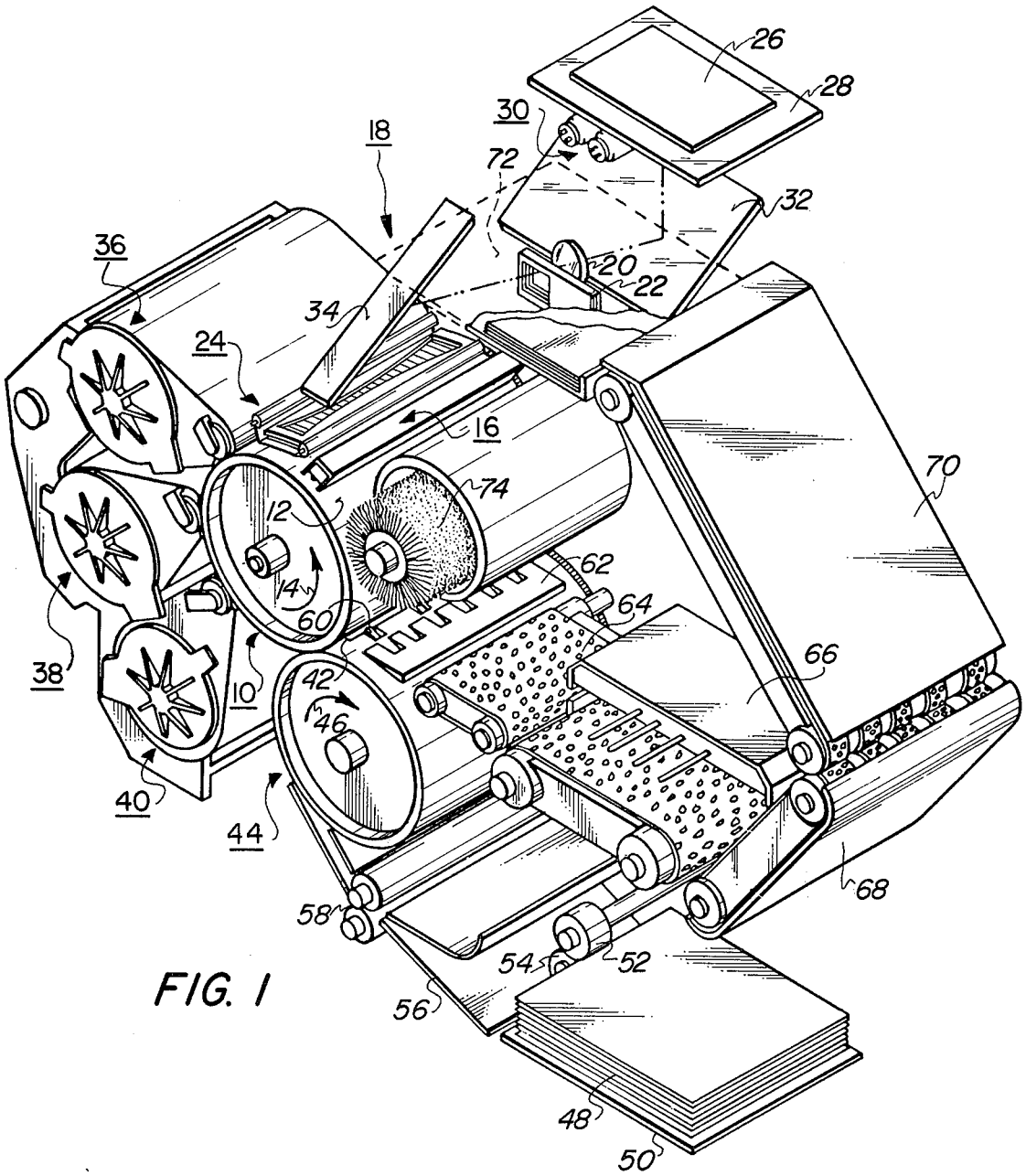
FIG. 1 is a schematic perspective view of an electrophotographic printing machine incorporating the features of the present invention therein.

With continued reference to the drawings, FIG. 1 schematically illustrates a color electrophotographic printing machine employing the features of the present invention therein. Hereinafter, like reference numerals shall be used throughout the drawings to designate like elements. The electrophotographic printing machine shown schematically in FIG. 1 illustrates the various sub-system components employed to produce colored copies from a colored original document. Although the optical system of the present invention is particularly well adapted for use in a multi-color electrophotographic printing machine, it will become evident from the following description that it is equally well suited for use in a wide variety of printing machines and is not necessarily limited to the particular embodiment shown herein.

As shown in FIG. 1, the printing machine employs a drum 10 having a photoconductive surface 12 secured to and entrained about the exterior circumferential surface thereof. Drum 10 is mounted rotatably within the machine frame (not shown). A series of processing stations are positioned about the periphery of drum 10. In this way, as drum 10 rotates in the direction of arrow 14, photoconductive surface 12 passes sequentially through each of the processing stations. Drum 10 is driven at a predetermined speed relative to the other machine mechanism by a drive motor (not shown). One type of suitable photoconductive material is described in U.S. Pat. No. 3,655,377 issued to Sechak in 1972. A timing disc is mounted in the region of one end of drum 10 and rotates in conjunction therewith. The timing disc is opaque and has a plurality of slits in the periphery thereof. A light source is mounted on one side of the timing disc and a photosensor on the other side thereof. As the timing disc rotates, light is transmitted through the slits in the periphery to actuate the photosensor. The photosensor, in conjunction with suitable logic circuitry, controls the sequencing of events at each of the processing stations. This coordinates the various machine operations with one another to produce a proper sequence of events at each processing station.

Initially, drum 10 moves photoconductive surface 12 through charging station A. At charging station A, a corona generating device, indicated generally as 16, extends in a generally longitudinal direction transversely across photoconductive surface 12. Corona generating device 16 charges photoconductive surface 12 to a relatively high substantially uniform potential. Preferably, corona generating device 16 is of the type described in U.S. Pat. No. 2,778,946 issued to Mayo in 1957.

After photoconductive surface 12 of drum 10 is charged, drum 10 rotates to exposure station B. Exposure station B includes thereat the optical system of the present invention, generally designated by the reference numeral 18. Optical system 18 has a moving lens system, generally designated by the reference numeral 20, a color filter, shown generally at 22, and a screen and light attenuating member, shown generally at 24. Original document 26 is positioned upon transparent viewing platen 28. Lamps 30 are located beneath transparent viewing platen 28 to illuminate original document 26. Lamps 30, lens 20 and filter 22 move in a timed relationship with drum 10 to scan successive incremental areas of document 26 disposed upon platen 28. Mirror 32 reflects the light rays transmitted from original document 26 through lens 20 forming a light image. The light image is transmitted to filter 22, i.e., a selected color separation filter inserted into the path of the light rays. Thereafter, the single color light image is reflected from a second mirror 34 through screen and attenuator member 24 which transmits a finely divided uniformly distributed light image having substantially uniform intensity onto photoconductive surface 12. The light image selectively dissipates the charge on photoconductive surface 12 in the irradiated areas recording a single color electrostatic latent image thereon. As heretofore indicated, the appropriate color filter operates on the light image to record an electrostatic latent image on photoconductive surface 12 corresponding to a preselected spectral region of the electromagnetic wave spectrum, hereinafter referred to as a single color electrostatic latent image. Optical system 18 will be discussed, in greater detail, with reference to FIG. 2. Screen and attenuator member 24 will be discussed in greater detail with reference to FIGS. 3 through 5, inclusive.

Returning once again to FIG. 1, after exposure, drum 10 rotates the single color electrostatic latent image recorded on photoconductive surface 12 to development station C. Development station C includes three individual developer units, generally indicated by the reference numerals 36, 38 and 40, respectively. Preferably, each developer unit is of a type generally referred to as a magnetic brush developer unit. A typical magnetic brush developer unit employs a magnetizable developer mix of carrier granules and toner particles. The developer mix is continually brought through a directional flux field to form a brush thereof. Each developer unit includes a developer roll electrically biased to the appropriate potential and proper polarity such that the toner particles are attracted from the carrier granules to the areas of photoconductive surface 12 having a greater charge thereon, i.e., the single color electrostatic latent image. The single color electrostatic latent image recorded on photoconductive surface 12 is developed by bringing the developer mix into contact therewith. Each of the respective developer units contain discretely colored toner particles corresponding to the complement of the spectral region of the wave length of light transmitted through filter 22, e.g., a green filtered electrostatic latent image is rendered visible by depositing green absorbing magenta toner particles thereon. Blue and red latent images are developed with yellow and cyan toner particles, respectively. A suitable development system is described in copending application Ser. No. 255,259 filed in 1972, now U.S. Pat. No. 3,854,449, the disclosure of which is hereby incorporated into the present application.

After the electrostatic latent image is developed on photoconductive surface 12, drum 10 rotates the toner powder image to transfer station D. At transfer station D, the toner powder image adhering electrostatically to photoconductive surface 12 is transferred to a sheet of support material 42. Support material 42 may be plain paper, or a sheet of thermoplastic material. A transfer roll, shown generally at 44, rotates support material 42 in the direction of arrow 46. Transfer roll 44 is electrically biased to a potential of sufficient magnitude and the proper polarity to electrostatically attract toner particles from photoconductive surface 12 to a support material 42. U.S. Pat. No. 3,612,677 issued to Langdon et al. in 1972, discloses a suitable electrically biased transfer roll. Transfer roll 44 is arranged to rotate in synchronism with drum 10, i.e., transfer roll 44 and drum 10 rotate at substantially the same angular velocity and have substantially the same diameter. As shown in FIG. 1, transfer roll 44 rotates in the direction of arrow 46. Inasmuch as support material 42 is secured to transfer roll 44, for movement therewith in a recirculating path, successive toner powder images may be transferred from photoconductive surface 12 to support material 42, in superimposed registration with one another. This enables a multi-layered toner powder image to be formed on support material 42. Each of the successive layers of toner powder are in superimposed registration with one another forming a multi-layered toner powder image.

Prior to proceeding with the remainder of the processing stations positioned about the periphery of drum 10, the sheet feeding path will be briefly described hereinafter. A stack 48 of support material 44 is positioned on tray 50. Feed roll 52, operatively associated with retard roll 54, separates and advances the uppermost sheet from stack 48. The advancing sheet moves into chute 56 which directs it into the nip of register rolls 58. Register rolls 58 align the advancing sheet and continue the forward movement thereof to gripper fingers 60 mounted on transfer roll 44. Gripper fingers 60 releasably secure support material 42 onto the surface of transfer roll 44 for movement therewith in a recirculating path. After substantially all of the discretely colored toner powder images have been transferred to support material 42, gripper fingers 60 space support material 42 from transfer roll 44. This enables gripper bar 62 to be interposed between support material 42 and transfer roll 44 separating support material 42 therefrom. After support material 42 is stripped from transfer roll 44, it is moved on endless belt conveyor 64 to fixing station E.

At fixing station E, a suitable fuser, generally indicated at 66, heats the multi-layered powder image to permanently affix it to support material 42. A typical fuser is described in U.S. Pat. No. 3,498,592 issued to Moser in 1970. After fusing the multi-layered toner powder image to support material 42, endless belt conveyors 68 and 70 advance support material 42 to catch tray 72. Catch tray 72 is disposed in the printing machine such that the operator may readily remove the final multi-colored copy therefrom.

Returning now to the various processing stations disposed about the periphery of drum 10, after the toner powder image has been transferred to the sheet of support material some residual toner particles remain on photoconductive surface 12. These residual toner particles are removed from photoconductive surface 12 as it passes through cleaning station F. At cleaning station F, a cleaning corona generating device (not shown) neutralizes the electrostatic charge remaining on the residual toner particles and photoconductive surface 12. The neutralized toner particles are then removed from photoconductive surface 12 by rotatably mounted brush 74 in contact therewith. A suitable brush cleaning device is described in U.S. Pat. No. 3,590,412 issued to Gerbasi in 1971.

It is believed that the foregoing description is sufficient for purposes of the present application to illustrate the general operation of an electrophotographic printing machine embodying the teachings of the present invention therein.

Figure 2:
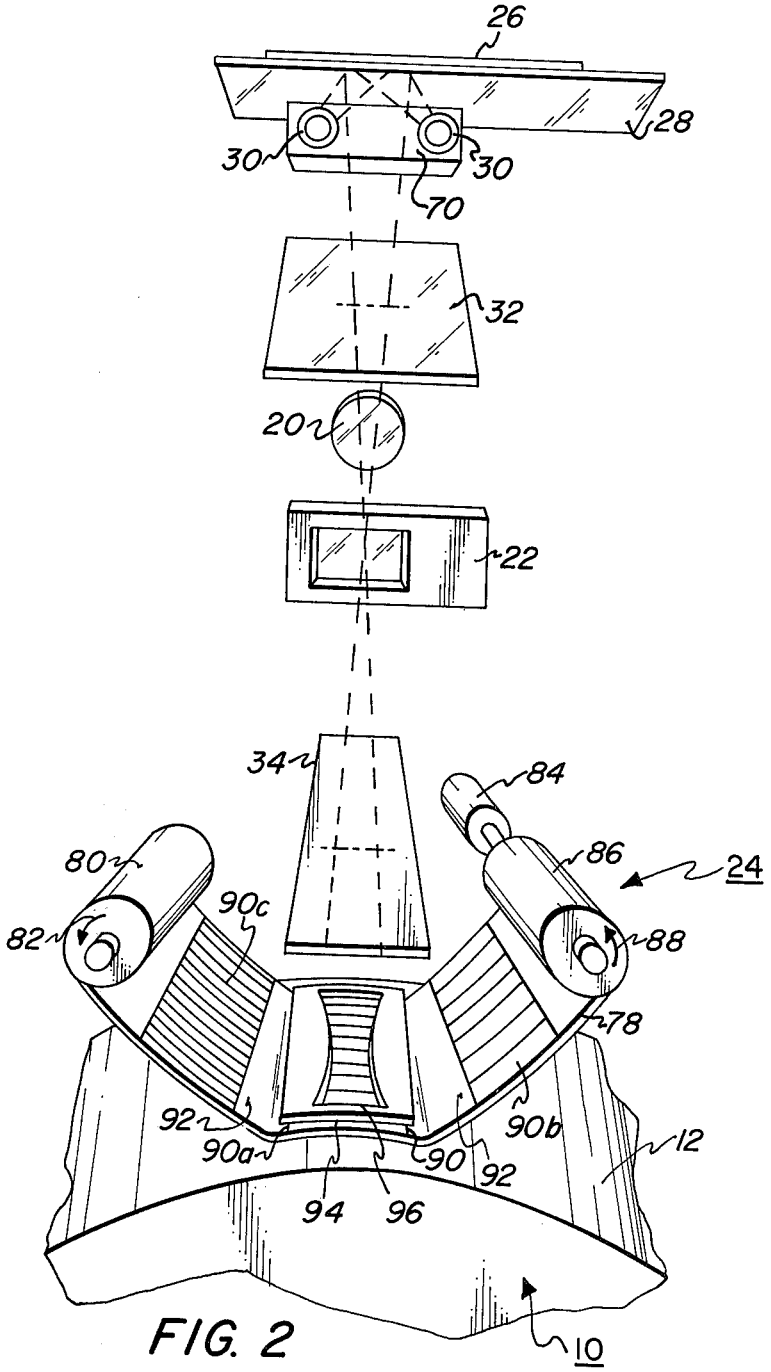
FIG. 2 is a schematic perspective view of an optical system employed in the FIG. 1 printing machine.
Figure 4:
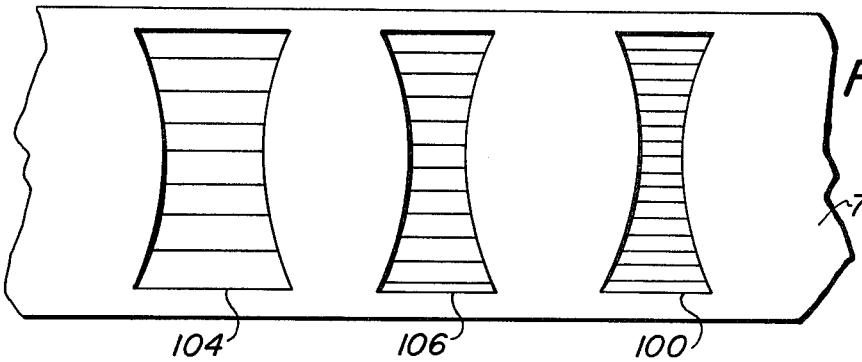
FIG. 4 is a fragmentary plan view showing a plurality of screened light attenuating members for use in the FIG. 2 optical system.
Figure 5:
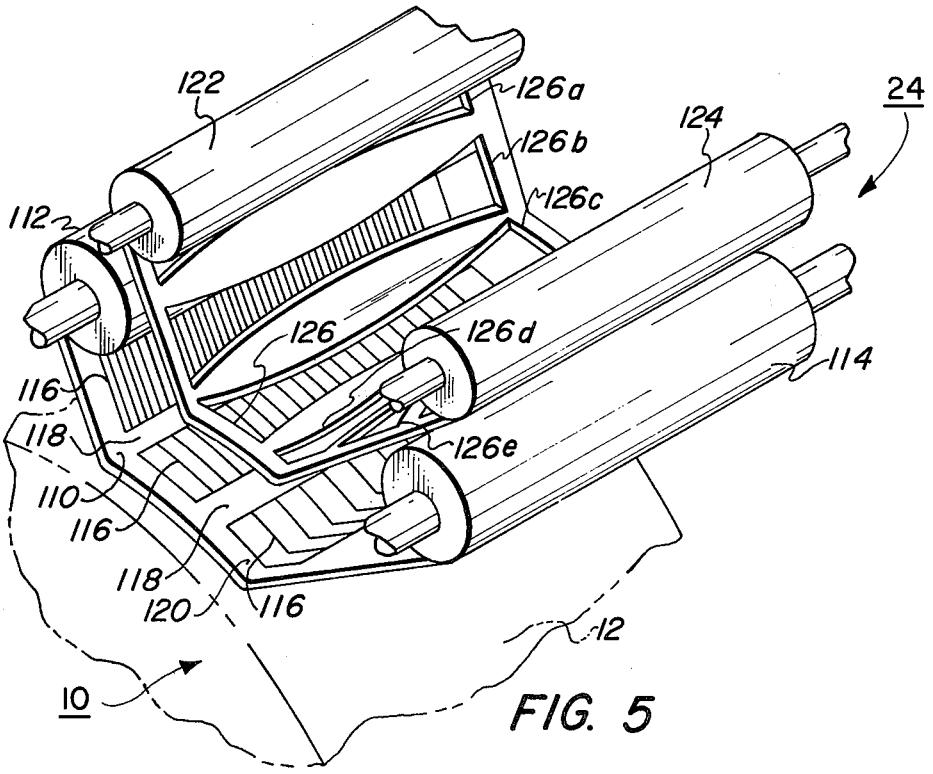
FIG. 5 is a schematic perspective view illustrating a plurality of screened members in combination with a plurality of light attenuating members for use in the FIG. 2 optical system.

Referring now to FIG. 2, optical system 18 is depicted therein in greater detail and will hereinafter be described. Optical system 18 includes lamp carriage 76 supporting a pair of light sources or lamps 30 thereon. Lamp carriage 76 is arranged to traverse platen 28 illuminating incremental widths of original document 26 disposed thereon. A cable-pulley system driven by a motor (not shown) driving drum 10 moves lamp carriage 76. As lamp carriage 76 traverses platen 28, another cable-pulley system acts to move lens 20 at a correlated speed therewith on suitable rollers surrounding a shaft (not shown). Filter assembly 22 is mounted by a suitable bracket on lens 20 so as to move therewith. Screening and attenuating member 24 is mounted on the machine frame by a suitable bracket and interposed between mirror 34 and photoconductive surface 12. Screening and attenuator member 24 includes an endless belt 78 entrained about roller 80 and adapted to rotate in the direction of arrow 82. Stepping motor 84 is adapted to index roller 86 in the direction of arrow 88. Belt 78 is a flexible metallic member having a plurality of screened portions 90 thereon or a plastic belt having metal screen inserts. As shown in FIG. 2, screen **90*a* is interposed into the optical path and includes a plurality of lines. Preferably, this type of screen may be formed by a photo-etching process. Interposed between screen 90*a* and the adjacent screen 90*b* is a transparent portion 92. Screen 90*b* also includes a plurality of lines thereon. Screen 90*c*, once again, includes a plurality of lines. However, the spacing or line frequency differs on each of the screens; i.e., screen 90*a* may have 100 lines per inch; screen 90*b*, 200 lines per inch; and screen 90*c*, 300 lines per inch. Hence, it is evident that a plurality of different types of screens may be placed on belt 78. Actuation of stepping motor 84 indexes belt 78 so that the desired screen is interposed into the optical light path, i.e., in a light receiving relationship with the light image. In the event that a functional copy is being reproduced, stepping motor 84 indexes belt 78 such that clear or transparent portion 92 is interposed into the optical light path and the screen is spaced therefrom. In the embodiment shown in FIG. 2, light attenuator member 94 is disposed between screen 90 and mirror 34. FIGS. 4 and 5**, hereinafter to be discussed, describe various embodiments of this arrangement.

With continued reference to FIG. 2, light attenuator member 94 is a sheet of substantially opaque material. Preferably, light attenuator member 94 is formed from sheet metal having a black coating or paint thereon. The area of slit 96 increases from the central region to the marginal regions thereof. The areas are a minimum in the central region and increases in accordance with the $Cos^4$ law to the marginal regions. In this manner, the light rays transmitted through attenuator member 94 are of a minimum intensity in the central region and of a maximum intensity in the marginal regions. Thus, a light image having its maximum intensity in the central region which decreases in accordance with the $Cos^4$ from the central region to the marginal regions thereof will have a substantially uniform intensity after passing through slit 96.

Preferably, lens 20 is a six element split dagor type of lens system having front and back compound lens components with a centrally located diaphragm located therebetween. This lens system forms a high quality image with a field of angle of about 31°, a speed of *f*/8.0, and 1:1 magnification. in addition, the lens is designed to minimize the effects of secondary color at the image plane. The front lens component has three lens elements including, in the following order: first lens element of positive power, a second lens element of negative power cemented to the first lens element, and a third lens element of positive power disposed between the second lens element and diaphragm. The back lens component also has three similar lens elements positioned so that lens 20 is symmetrical. In the specific embodiment of this lens, the first lens element of the first component is a double convex lens, the second lens element a concave lens and the third lens element a convex-concave lens element. For further details regarding lens 20, reference is made to U.S. Pat. No. 3,592,531 issued to McCrobie in 1971, the relevant portions thereof being hereby incorporated into the present application.

Filter 22 comprises a housing which is mounted on lens 20 by a suitable bracket to move in conjunction therewith. The housing of filter 22 includes a window which is positioned relative to lens 20 so as to permit the light rays reflected from original document 26 on platen 28 to pass therethrough. The bottom and top walls of the housing member include a plurality of tracks which extend the entire width thereof. Each track is adapted to carry a filter in a manner to permit movement of the filter to an operative position interposed in the window of the housing permitting light rays to pass therethrough. The individual filters are made of any suitable filter material, such as "coated glass." The number of filters utilized in the electrophotographic printing machine of FIG. 1 is three. These filters are resiliently urged into position by individual extension springs. When inoperative, the filters are maintained spaced from the optical light path of the housing window by means of a stop pin extending up through an opening in the bottom of the housing member in the respective track of each filter. A solenoid, in association with the stop pins, retains the filters in the inoperative position. A selected filter is inserted in the optical light path of the housing window by activation of the appropriate solenoid. Activation of the selected solenoid moves the stop downwardly from the track of the appropriate filter. This permits the spring to pull the filter into the optical light path of the housing window. When a filter is moved into the operative position in the housing window, it will remain there throughout the entire scanning of the original document. A suitable filter mechanism is described in U.S. Pat. No. 3,775,006 issued to Hartman et al. in 1973. The relevant portions of that disclosure is hereby incorporated into the present application.

Light source of lamp 30 include three phosphors having a blue/green ratio preferably of about 0.3 and a red/green ratio preferably of about 0.53. The spectral energy distribution of the red output is about 44 microwatts per centimeter squared, the green output about 82 microwatts per centimeter squared, and the blue output about 25 microwatts per centimeter squared. Lamp 30 operates at about 37 watts, 40 volts and at about 1 ½ amps RMS. The exterior circumferential surface of lamp 30 is opaque with a clear region extending over about a 45° arc. The clear region extends substantially along the entire length of the tubularly configured lamp 30. As hereinbefore indicated, lamp 30 is a triphosphor lamp having peak energy outputs in the region of the blue, green and red wave lengths. The corresponding filters are arranged to permit a single color light image having a specific band width to pass therethrough. Hence, a blue filter only permits a light image in the blue region to be transmitted therethrough. Similarly, a red filter permits only a red light image, and a green filter only a green light image. The light image transmitted through filter 22 is directed onto the screen portion of belt 78 by mirror 34.

Figure 3:
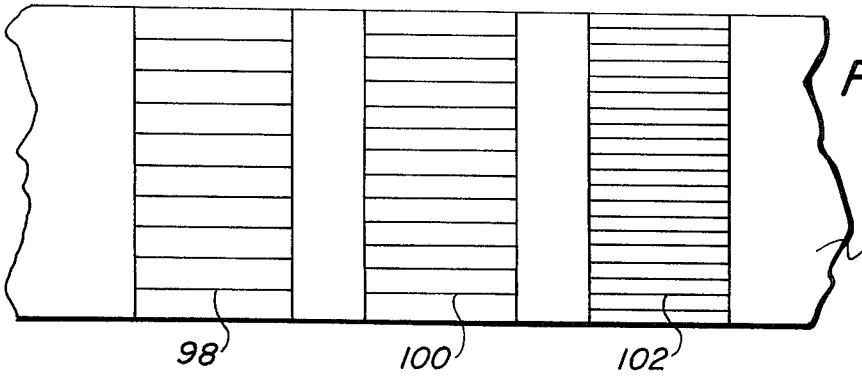
FIG. 3 is a fragmentary plan view depicting a plurality of screen members for use in the FIG. 2 optical system.

Referring now to FIG. 3, various types of screens will be described in greater detail. As shown in FIG. 3, belt 78 has three exemplary screens disposed thereon, each screen being substantially rectangularly configured. Thus, the intensity of the light image transmitted therethrough has the same distribution as that of the light source. Hence, the light image transmitted through each of the screens will have the intensity thereof decreasing outwardly from the central region to the marginal regions in accordance with the $Cos^4$ law. To compensate for this effect, a suitable light attenuating member 94, such as was hereinbefore described with reference to FIG. 2, would be required. Light attenuator member 94 decreases the intensity of the light image in the central region while maintaining the intensity of the light image constant at the marginal region so as to provide a substantially uniform intensity light image for irradiating photoconductive surface 12.

Screen 98 has a plurality of equally spaced lines thereon. Preferably, screen 98 has about 85 lines per inch. Similarly, screen 109 also has a plurality of equally spaced lines thereon. Screen 100 may have approximately 150 lines per inch. Other screens having anywhere from 50 to 300 lines per inch are also disposed upon belt 78, i.e., screens 102 has 250 lines per inch. Screens having 100, 200, 300, 400 and even more lines to the inch are also disposed upon belt 78. The screen portions of belt 78 may be formed by a suitable evaporative or chemical etching technique as well as by printing and photographic techniques.

Turning now to FIG. 4, another embodiment of belt 78 is depicted therein. As shown in FIG. 4, each screen is arcuately configured. The area of the screen is configured in the shape of a butterfly slit, wherein the area increases in accordance with the $Cos^4$ law from the central region to the marginal regions thereof. Thus, screen 104 includes a plurality of closely spaced lines with the central region thereof narrower than the marginal regions thereof. The area increases outwardly from the central region to the marginal region in accordance with the $Cos^4$ law. As shown in FIG. 4, the plurality of equally spaced lines are narrower in the central region than the marginal regions thereof. With this type of arrangement, the light attenuator 94 of FIG. 2 would not be required. Screen 104 serves both functions, i.e., to attenuate the light image so as to insure that is has substantially uniform intensity and to divide the light image into finely divided uniformly distributed portions. In this way, a uniform intensity continuous tone light image will irradiate charged photoconductive surface 12. Preferably, screen 104 has 150 lines per linear inch. Screen 106 is similar to screen 104. However, screen 106 has less lines per linear inch and the area of the slit formed thereby is smaller. Thus, less light will pass through the slit and the intensity of the light image, through uniform, will be diminished. Preferably, screen 106 has about 100 lines per linear inch. Finally, screen 108 has about 250 lines per linear inch. In addition, the area thereof is substantially less than screen 106 and screen 104. As hereinbefore indicated, the screens of FIG. 4 may be formed by a suitable evaporative or chemical etching technique as well as by printing and photographic techniques. The screens themselves may be made from any number of opaque metallic materials suitable for chemical etching, such as copper or aluminum. Belt 78 includes a plurality of such screen members. The appropriate screen having the requisite area is determined during the calibration process. Calibration of an electrophotographic printing machine is described in U.S. Pat. No. 3,799,668 issued to McVeigh in 1974, the relevant portions thereof being hereby incorporated into the present application.

Referring now to FIG. 5, there is shown still another embodiment of screening and attenuator member 24. As shown in FIG. 5, endless belt 110 is entrained about roller 112. Belt 110 is also entrained about roller 114. Roller 114 is driven by a stepping motor (not shown). The stepping motor indexes roller 114 such that the appropriate screen on belt 110 is interposed into the optical light path. The configuration of belt 110 is substantially indentical to that hereinbefore described with reference to FIG. 3. Thus, belt 110 includes a plurality of substantially rectangular screens 116 spaced apart from one another by transparent portions 118. Screens 116 are line screens having the requisite number of lines per linear inch. Thus, screens 116 may have anywhere from 50 to 400 lines per linear inch. Belt 110 is interposed between belt 120 and photoconductive surface 12. Belt 120 is formed from a flexible substantially opaque material and is entrained about rollers 122 and 124. A suitable stepping motor (not shown) indexes belt 120. As roller 122 rotates differing size exposure slits 126 are interposed into the optical light path. Each exposure slit is substantially shaped in the configuration of a butterfly having the central region thereof substantially narrower than the marginal regions. Slit **126*a* preferably has a maximum width in the marginal regions thereof of about 0.682 inches and a minimum width of about 0.542 inches in the central region thereof. Slit 126*b* has a maximum width of about 0.751 inches in the marginal regions thereof and a minimum width of about 0.597 inches in the central region thereof. Slit 126*c* has a maximum width of about 0.829 inches in the marginal regions thereof and a minimum width of about 0.659 inches in the central region thereof. Slit 126*d* has a maximum width of about 0.931 inches in the marginal regions thereof and a minimum width of about 0.726 inches in the central region thereof. Finally, slit 126*e* has a maximum width of 1.006 inches in the marginal region thereof and a minimum width of about 0.8000 inches in the central region thereof. In all of the foregoing cases, the slit area is proportional to the $Cos^4$ law. In this manner, the intensity of the light image transmitted through slit 126 is substantially uniform. Thus, slit 126 decreases the intensity of the light image inversely proportional to the $Cos^4$ law from the central region to the marginal regions thereof. In operation, the light image passes through screen 116 and then slit 126. The resulting light image irradiating photoconductive surface 12** is a continuous tone finely divided uniformly distributed light image having substantially uniform intensity.

One skilled in the art will realize that a finer screen size generally results in a more naturally higher quality copy. Hence, while a coarse screen having 50 to 60 lines per linear inch will be useful for some purposes such as direct production of half-tone images, fine screens such as those having 100, 200, 300, 400 and even more lines per linear inch will have a more nearly continuous tone appearance on the finished copy. With finer screens, the screen pattern may be barely perceptible in the finished copy and the copy will have the appearance of a continuous tone photograph.

The contrasting appearance obtained without the use of a screen may be highly desirable in the case of the formation of functional copies rather than pictorial quality copy. This is readily achievable by interposing a transparent portion rather than a screened portion in the optical light path. Light images transmitted through the screen or transparent portion is acted upon by the exposure slit. The exposure slit is adapted to diminish the intensity of the light image in the central region while maximizing the transmission of the light image in the marginal regions. To this end, the area of the exposure slit is inversely proportional to the $Cos^4$ law. This insures that the light image transmitted through the exposure slit has substantially uniform intensity for irradiating the charged photoconductive surface therewith.

In recapitulation, it is apparent that various types of screens may be combined with different size exposure slits to optimize the copy being reproduced in an electrophotographic printing machine. In one embodiment hereinbefore described, a fixed size slit is employed in association with a plurality of screens having differing line frequencies. The screen is mounted on an endless belt. Another embodiment utilizes a screen integral with an exposure slit. To this end, a plurality of such screens having the central region thereof of a minimum width while the marginal regions thereof are of a maximum width which are disposed upon a belt. The belt is indexed until the appropriate screen is in the optical light path. Finally, a third embodiment utilizes a plurality of screens mounted on an endless belt and a plurality of exposure slits mounted on another endless belt. In operation, the operator may select the appropriate screen and the optimum exposure slit to produce a high quality pictorial copy.

It is, therefore, apparent that there has been provided in accordance with the present invention, an optical system for producing continuous tone light images having substantially uniform intensity. The optical system fully satisfies the objects, aims and advantages hereinbefore set forth. While the present invention has been described in conjunction with specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What I claim is:

1. An optical system including:

a light source positioned to illuminate an original document with light rays;

a lens in a light receiving relationship with the light rays transmitted from the original document to form a light image thereof;

a plurality of screen members;

a belt member having each of said screen members mounted thereon in a spaced relationship with one another;

means for movably supporting said belt member;

means for moving said belt member to position a pre-selected one of said screen members in the optical light path in a light receiving relationship with the light image transmitted from said lens with the other of said screen members being spaced from the optical light path;

a substantially opaque belt member having a plurality of spaced slits therein, each of the slits decreasing the intensity of the light image inwardly from the marginal regions to the central region thereof;

means for movably supporting said opaque belt member; and means for moving said opaque belt member to position a pre-selected one of said slits in the optical light path in a light receiving relationship with the light image transmitted from said lens with the other slits therein being spaced from the optical light path.

2. A system as recited in claim 1, further including means for filtering the light image to form a substantially single color light image.

3. A system as recited in claim 2, wherein each of said plurality of said screen members include a plurality of substantially equally spaced lines.

4. A system as recited in claim 3, wherein each of said plurality of screen members include differing numbers of equally spaced lines.

5. An electrophotographic printing machine, including:

a photoconductive member;

means for charging said photoconductive member to a substantially uniform level;

exposure means for creating a light image of an original document and projecting the light image onto the charged portion of said photoconductive member recording an electrostatic latent image thereon, said exposure means comprising a light source positioned to illuminate the original document with light rays, a lens in a light receiving relationship with the light rays transmitted from the original document to form a light image thereof, a plurality of screen members, a belt member having each of the screen members mounted thereon in a spaced relationship with one another, means for movably supporting the belt member, and means for moving the belt member to position a pre-selected one of the screen members in the optical light path in a light receiving relationship with the light image transmitted from the lens with the other of the screen members being spaced from the optical light path;

a substantially opaque belt member having a plurality of spaced slits therein, each of the slits decreasing the intensity of the light image inwardly from the marginal regions to the central region thereof;

means for movably supporting said opaque belt member; and means for moving said opaque belt member to position a pre-selected one of said slits in the optical light path in a light receiving relationship with the light image transmitted from the lens of said exposure means with the other slits therein being spaced from the optical light path.

6. A printing machine as recited in claim 5, further including:

means for developing the electrostatic latent image recorded on said photoconductive member with toner particles;

means for transferring the developed powder image from said photoconductive member to a sheet of support material; and means for affixing substantially permanently the toner powder image to the sheet of support material.

7. A printing machine as recited in claim 6, wherein said exposure means includes means for filtering the light image to form a substantially single color light image.

8. A printing machine as recited in claim 7, wherein the plurality of screen members of said exposure means include a plurality of substantially equally spaced lines.

9. A printing machine as recited in claim 8 wherein each of the plurality of screen members of said exposure means include differing numbers of equally spaced lines.

* * * * *